United States Patent [19]

Izumida et al.

[11] Patent Number: 4,793,947

[45] Date of Patent: Dec. 27, 1988

[54] RADIOACTIVE WASTE TREATMENT METHOD

[75] Inventors: Tatsuo Izumida, Hitachi; Hideo Yusa; Kiyomi Funabashi, both of Katsuta; Makoto Kikuchi; Shin Tamata, both of Hitachi, all of Japan

[73] Assignee: Hitachi, Ltd., Tokyo, Japan

[21] Appl. No.: 852,821

[22] Filed: Apr. 16, 1986

[30] Foreign Application Priority Data

Apr. 17, 1985 [JP] Japan ..... 60-80200

[51] Int. Cl.[4] ..... G21F 9/16

[52] U.S. Cl. ..... 252/628; 106/74; 106/76; 106/77; 210/682; 210/683; 210/685; 210/751; 423/11; 423/12; 423/158; 423/181; 423/184; 252/631

[58] Field of Search ..... 106/74, 76, 77, 89, 106/90, 97; 252/628, 631; 210/682, 681, 685, 751, 683, 670, 667; 423/11, 12, 15, 16, 157, 158, 181, 184, 333

[56] References Cited

U.S. PATENT DOCUMENTS

| | | | |
|---|---|---|---|
| 4,122,048 | 10/1978 | Buchwalder et al. | 252/628 |
| 4,293,437 | 10/1981 | Taponier et al. | 106/96 |
| 4,349,513 | 9/1982 | Ishiwata et al. | 252/631 |
| 4,482,481 | 11/1984 | Bandyopadhyay et al. | 252/628 |
| 4,483,789 | 11/1984 | Kunze et al. | 252/628 |
| 4,501,691 | 2/1985 | Tanaka et al. | 252/631 |
| 4,518,508 | 5/1985 | Conner | 252/628 |
| 4,530,723 | 7/1985 | Smeltzer et al. | 252/628 |
| 4,581,162 | 4/1986 | Kawamura et al. | 252/628 |
| 4,671,897 | 6/1987 | Mori et al. | 252/628 |

FOREIGN PATENT DOCUMENTS

| | | | |
|---|---|---|---|
| 0186099 | 10/1983 | Japan . | |
| 59-12399 | 1/1984 | Japan . | |
| 0171898 | 9/1984 | Japan | 252/628 |
| 0165000 | 9/1984 | Japan | 252/631 |
| 0208498 | 11/1984 | Japan | 252/628 |
| 0082895 | 11/1985 | Japan | 252/628 |

*Primary Examiner*—Stephen J. Lechert, Jr.
*Assistant Examiner*—Howard J. Locker
*Attorney, Agent, or Firm*—Fay, Sharpe, Beall, Fagan, Minnich & McKee

[57] ABSTRACT

The present invention relates to a method and an apparatus for producing a waste package of radioactive waste containing particles of radioactive waste material of low modulus of elasticity, particles of radioactive waste material of high modulus of elasticity, and a solidifying agent in which the particles of radioactive waste material of low modulus of elasticity and the particles of radioactive waste material of high modulus of elasticity are fixed in an almost uniformly dispersed state. According to this invention, the radioactive waste generated from nuclear power plants can be greatly reduced in volume and also a waste package of radioactive waste with high strength and excellent water resistance can be obtained.

21 Claims, 8 Drawing Sheets

RADIOACTIVE WASTE TREATMENT METHOD

BACKGROUND OF THE INVENTION

This invention relates to a waste package of radioactive waste and a method of producing such a waste package of radioactive waste. More particularly, the invention relates to a treatment of concentrated radioactive waste liquid generated from nuclear power plants, etc., and a used ion exchange resin also released from such plants while carrying radioactive substances thereon.

Compaction (volume reduction) and solidification of radioactive wastes generated from nuclear power plants is not only important for securing the space for storage of radioactive wastes within the compounds of power stations but is also a key factor for storage on land which is one of the final disposal methods. Efforts have been made for finding effective means for volume reduction of radioactive waste and a method has been proposed in which a slurry of concentrated waste liquid (basically composed of $Na_2SO_4$) and used ion exchange resin, which are the main wastes produced from BWR power plants, is dried and powdered to remove water which occupies a substantial portion of the whole volume of radioactive waste and the powdered material is pelletized. It has been confirmed that this method can realize a volume reduction to approximately ⅛ based on the conventional method in the waste liquid or slurry is directly solidified with cement. However, even this method, though remarkable in its volume reducing effect, has a drawback that it is unable to form a stable solidified body when using a hydraulic solidifying agent such as cement. This is for the reason that the pellets principally composed of $Na_2SO_4$ or ion exchange resin swell up by absorbing water contained in the solidifying agent to cause break of the solidified body. As a souution to this problem, a method has been proposed in which an alkali silicate solution is used as solidifying agent and a water absorbing agent is added thereto to make a more stable solidified body of pellets (Japanese Patent Laid-Open 197500/82). Any of the proposed methods, however, involves difficulties in pelletizing the dry powder and also has a problem of high cost due to the necessity of using a drying and powdering apparatus as well as a pelletizing machine.

To avoid these problems, studies are also made on the method in which the dry powder is not pelletized but directly mixed uniformly with a solidifying material and solidified. In this case, plastic, asphalt or inorganic solidifying medium is used as solidifying agent.

For plastic solidification, usually a thermosetting resin is used as solidifying agent, but thermosetting resin becomes unable to fully perform its ability as solidifying agent if even a slight amount of water is mixed therein. This is for the following raason.

When water is brought into the powder-resin mixture in the course of solidification, the hardening promotors (such as cobalt naphthenate) in the thermosetting resin are decomposed to retard hardening of the resin, causing a part of the resin to leave in the state (liquid) it had at the time of addition.

Even if the used ion exchange resin or $Na_2SO_4$ is carefully dried, water may not be removed perfectly.

Thus, if the used ion exchange resin or $Na_2SO_4$ containing even a slight quantity of water and a thermosetting resin are mixed and solidified, there cannot be obtained a solidified body with high strength. Therefore, the powder dried by a drying means such as thin-film dryer must be placed under a strict moisture control by constantly measuring the moisture content by a neutron moisture meter or other means.

In case of using asphalt, said moisture control becomes unnecessary since the powder of waste material is heated while mixed with asphalt to remove moisture and then solidified. Asphalt, however, because of its thermoplastic nature, has a problem that it is fluidized at 40°-50° C., so that the disposal or storage of asphalt-solidified waste material on land is undesirable.

Solidification by inorganic solidifying agent is preferred for storage and disposal of waste material on land because of good matching of such solidiying agent with soil and rock, and the solidification techniques by use of cement or sodium silicate (water glass) as solidifying agent are studied. Such solidifying agent is mixed with a proper amount of water and powder of waste material to form a solidified block. In this case, the powder of waste material is markedly increased in its contact area with the solidifying material and water, quite different from the case where the powder of waste material is compressed and shaped into pellets. Therefore, if the powder of waste material is chemically reacted with the solidifying agent, the formed solidified body is seriously affected by such chemical reaction. Also, in case the powder of waste material is of the type which is soluble in water, there is the possibility that outside water would penetrate into the solidified body through fine pores in the body and dissolve the waste material in the body, causing leakage of waste material to the outside of the solidified body. This problem is highlighted espccially in the case of dry powder (the main component being $Na_2SO_4$) of concentrated BWR waste liquid. For instance, when $Na_2SO_4$) powder is solidified with cement, calcium aluminate ($3CaO.Al_2O_3$) and calcium hydroxide ($Ca(OH)_2$) in the cement composition are reacted with sodium sulfate ($Na_2SO_4$) to produce ettrigite as shown by the following formula, which causes a volume expansion of the solidified body to break it.

$$3CaO.Al_2O_3 + 3Ca(OH)_2 + 3Na_2SO_4 + 32H_2O \longrightarrow 3CaO.Al_2O_3.3CaSO_4.32H_2O + 6NaOH \quad (1)$$

(ettrigite)

When sodium silicate (water glass) is used as solidifying agent, the reaction of formula (1) doesn't occur and therefore the problem of volume expansion can be evaded, but in case the solidified body is immersed in water, since sodium sulfate is soluble in water, it is hard to perfectly prevent the elution of waste material from the solidified body.

For solving this problem, it needs to turn the soluble sodium sulfate into a water-insoluble state, and as a method thereof, it has been propssed to coat the surface of sodium sulfate with a resin. This method, however, necessitates an extra apparatus for high-speed stirring of the mixture and also has a disadvantage that the volume of waste material to be treated is increased. The similar problems arise in case the dry powder of concentrated PWR waste liquid is solidified.

Use of inorganic solidifying agent for solidifying the dry powder of used ion exchange resin also involves the following problems associated with the properties of ion exchange resin:

(1) The hardening reaction of the solidifying agent is obstructed by the ion exchange groups (mostly $SO_3H$) in the ion exchange resin.

(2) The ion exchange resin swells as it absorbs water, causing a reduction of the waste packing rate.

It is possible to evade the problem of (1) by beforehand having the cations adsorbed on the ion exchange groups for inactivating them, but no effective countermeasure is available against the problem of (2)

SUMMARY OF THE INVENTION

An object of this invention is to obtain a waste package of radioactive waste which enables a striking reduction of the volume of radioactive waste generated from nuclear power plants and which is also high in strength and excellent in water resistance.

In accordance with this invention, there is provided a waste package of radioactive waste, said waste package containing particles of radioactive waste material of low modulus of elasticity, particles of radioactive waste material of high modulus of elasticity, and a solidifying agent by which said particles of radioactive waste material of low modulus of elasticity and said particles of radioactive waste material of high modulus of elasticity are fixed in an almost uniformly dispersed state in said agent after solidified.

The present invention also provides a method of producing a waste package of radioactive waste comprising adding to the radioactive waste liquid a substance which is combined with anions in said radioactive wast liquid and settles down as an insoluble substance, thus forming an insoluble precipitate of said anion-combined substance, then adding to said waste liquid a solid substance which adsorbs cations in said waste liquid to let said cations in said waste liquid settle together with said solid substance to form a precipitate thereof, and solidifying the mixture of said two types of precipitate to form a waste package.

The invention further provides a method of producing a waste package of radioactive waste, characterized by adding a hydroxide of an alkaline earth metal to the radioactive waste liquid mainly composed of sodium sulfate to form the water-soluble particles of radioactive watte and depositing them, then adding the used ion exchange resin to said waste liquid to have the sodium ions in said waste liquid adsorbed on said ion exchange resin to let them deposit together with said resin, and solidifying said precipitate with a solidifying agent.

DESCRIPTION OF THE PREFERRED EMBODIMENTS

Figure 1:
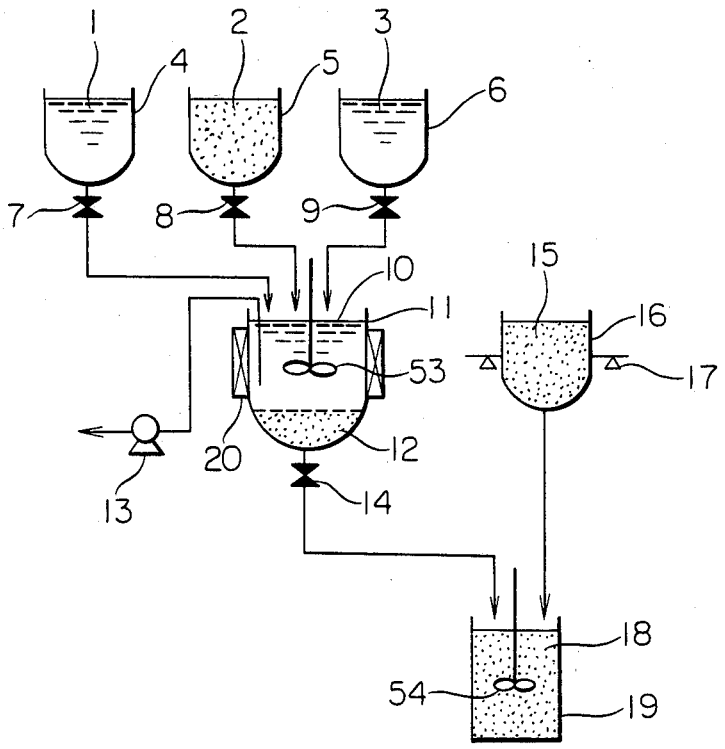
FIG. 1 is a flow chart of Example 1 of this invention.

The basic principle of the present invention is first described. Radioactive wastes produced from nuclear power plants, etc., are mostly composed of the substances shown in Table 1.

TABLE 1

Classification of radioactive wastes

| Source of generation | Waste |
|---|---|
| BWR power plants | Sulfuric acid ($H_2SO_4$)<br>Sodium hydroxide (NaOH) |
| PWR power plants | Boric acid ($H_3BO_3$) |
| Nuclear fuel reprocessing plants | Nitric acid ($HNO_3$)<br>Sodium hydroxide (NaOH) |

Thus, radioactive wastes can be classified into two types: acidic wastes and basic wastes. Usually, in consideration of corrosiveness of the storage tank, the waste liquids are stored in the state of being neutralized with each other or by further adding a basic substance. Whether neutralized or not, radioactive waste liquid contains only a few percent of solid radioactive material called "crud" including iron rust, and all of the principal components shown in Table 1 stay dissolved in the form of ions. For reducing the volume of such radioactive waste liquid, it has been practiced in the past to dry the waste liquid by a dryer to remove water therefrom to form a solid mass of the ions which have stayed dissolved in the waste liquid. This method, however, although high in the volume reducing effect, requires a high equipment cost as a dryer is needed. Also, since the solid mass produced by drying is still a soluble matter, it is necessary to give consideration to the possible elution of radioactive waste material.

As a solution to this problem, the present inventors hatched an idea of rendering the ionic matter in the waste liquid into an insoluble salt or adding to the waste liquid a solid substance which is capable of adsorbing the ionic matter to thereby remove the ionic matter from the waste liquid in the form of a precipitate (or sediment).

If the ionic matter in the radioactive waste liquid is settled into an insoluble precipitate, the remaining solution is neutral water alone and therefore it can be easily separated from the precipitate. According to this method, no drying step is required and also since the separated precipitate is formed as an insoluble matter, it is possible to eliminate any adverse effect of the sediment to the solidifying agent at the time of solidification and to also perfectly prevent the elution of radioactive waste material from the solidified body, i.e. the waste package.

The basic principle in converting the ionic matter in radioactive waste liquid into an insoluble precipitate according to the present invention is now described.

Regarding the individual ionic materials existing in waste liquid, for example, in sulfuric acid waste liquid from BWR power plants, there exist in such waste liquid sulfuric acid ions ($SO_4^{2-}$) and hydrogen ions ($H^+$) as cations. To such system is added a substance which is combined with said ions to form an insoluble salt. For instance, ions of an alkaline earth metal (such as $Ca^{2+}$, $Ba^{2+}$, etc.) are added to the sulfuric acid ions ($SO_4^{2-}$) to cause a reaction of the following formula through which said sulfuric acid ions are made into an insoluble salt and deposited.

$$SO_4^{2-} + Ba^{2+} \longrightarrow \underset{\text{(sediment)}}{BaSO_4} \quad (2)$$

Since hydrogen ions ($H^+$) cannot be sedimented, hydroxyl ions ($OH^-$) are added to convert such hydrogen ions into ordinary water. Generally, it is impossible to add ions alone into the solution, so that it needs to select a substance which is capable of giving said both cations and anions at the same time. In the above instance, both alkaline earth metal ions and hydroxyl ions can be added simultaneously by adding a hydroxide of an alkaline earth metal, for example, barium hydroxide ($Ba(OH)_2$). The reaction rate is unchanged no matter whether said barium hydroxide is added in the form of an aqueous solution or in the form of powder, and the reaction can be completed in a few minutes. By this method, the anions (sulfuric acid ions) can be settled into precipitate while the cations are made into water, and the precipitate alone needs to be solidified.

In the ordinary nuclear power plants, however, waste liquid is stored not in said state of sulfuric acid but in the form of a neutral solution formed by adding a basic substance such as sodium hydroxide. In this case, the ionic substances which exist in waste liquid are sulfuric acid ions ($SO_4^{2-}$).and sodium ions ($Na^+$). If alkaline earth metal ions are added to this system, the sulfuric acid ions are made into an insoluble precipitate in the way illustrated by formula (1). In this case, alkaline earth metal ions may be added in the form of a salt such as hydrochloride, nitrate, etc., or in the form of hydroxide. Addition in the form of a salt, however, is undesirable because of the possibility that there might be produced a soluble sodium salt bonded with sodium ions. Therefore, addition in the form of hydroxide is preferred. When said alkaline earth metal ions are added in the form of hydroxide, sodium hydroxide is produced beside the insoluble precipitate from the reaction shown by formula (3):

$$2Na^+ + SO_4^{2-} + Ba(OH)_2 \longrightarrow \underset{\text{(precipitate)}}{BaSO_4} + 2NaOH \quad (3)$$

Figure 2:
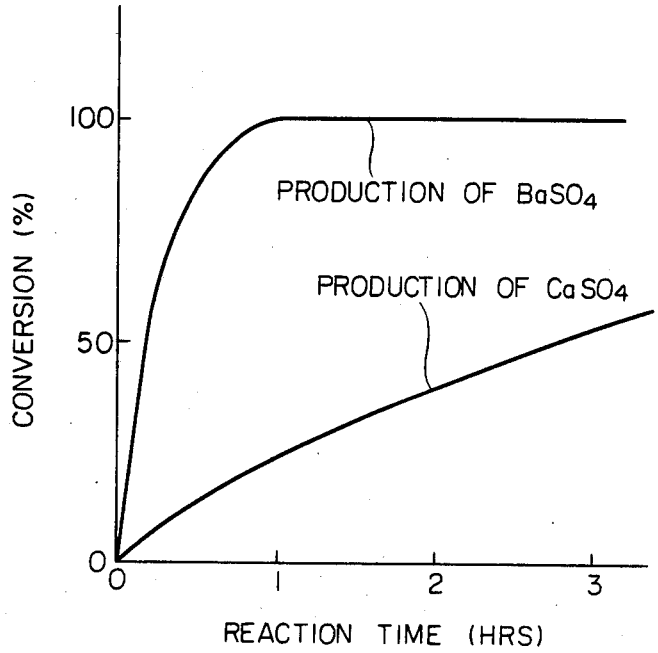
FIG. 2 is a graph showing the change with time of the conversion of the sulfate generated from the reaction of a hydroxide of barium or calcium and sodium sulfate.

If sodium hydroxide is removed by means of adsorption in the manner described below, the remaining waste liquid can be made into ordinary water. Also, by adding silicic acid ($H_2SiO_3$) to NaOH, it is possible to synthesize water glass, and such water glass can be utilized as a solidifying agent for the waste material. FIG. 2 shows the conversion rate in the reaction of formula (3) when barium hydroxide and calcium hydroxide were added severally to the aqueous solution of sodium sulfate. In case of adding barium hydroxide, 100% conversion can be achieved by the reaction of one hour at 80° C. In the case of calcium hydroxide, the conversion lowers to a fraction of the rate achievable in the case of barium hydroxide, and accordingly a longer time is required for the reaction, resulting in an increased processing cost. Thus, use of barium hydroxide is preferred. As for the kind of alkaline earth metal to be added, barium, calcium, strontium and magnesium are preferred in that order. The hydroxide of alkaline earth metal may be added either in the form of powder or as a solution thereof, but the former is preferred as a smaller capacity is required for the reaction vessel used. In case of adding powder, since the reaction starts after the powder was once dissolved in water to form alkaline earth metal ions, there is required water of at least an amount necessary for dissolving the powder, but this poses no problem as the concentration of waste liquid to be treated is usually of the order of 20% by weight.

When barium hydroxide is added to a concentrated waste liquid mainly composed of sodium sulfate, insoluble barium sulfate is produced and the concentrated waste liquid becomes white turbid. This white turbidity occurs as the particles of barium sulfate exist in a suspended state, but the liquid does not become viscous and is capable of easy filtration. The solid matter which remains after the filtration contains barium sulfate produced by the insolubilization reaction and iron oxides called radioactive crud from nuclear power plants. The same holds true in case the main component of concentrated waste liquid is sodium borate or sodium sulfate. This solid matter may be stored in the form as it is, but preferably it is solidified with a suitable solidifying agent such as cement, water glass or plastic and stored as a solidified body of waste package.

On the other hand, the filtrate, which becomes a sodium hydroxide solution, may be recovered as is, but when a solid substance which adsorbs sodium ions and is deposited is added, said sodium hydroxide solution can be resolved into a precipitate and ordinary water. For realizing this, however, the solid substance added needs to be the one which is capable of adsorbing sodium ions while releasing hydrogen ions. Ion exchange resin is a typical example of such substance. The present inventors found that the used ion exchange resin which is discharged as a waste material from nuclear power plants can be used for said purpose because such used ion exchange resin, when discharged out, still maintains more than 90% of its normal ion exchange capacity. The present invention is thus a very significant attainment from the aspect of volume reduction of radioactive wastes. The cation exchange resin which accounts for two thirds of the used ion exchange resin adsorbs cations such as sodium ions and releases hydrogen ions.

Thus, when ion exchange resin is added to said sodium hydroxide solution, sodium ions are adsorbed by said resin while hydroxy ions are reduced into ordinary water through the following reaction:

$$Na^+ + OH^- + \underset{\text{(ion exchange resin)}}{R-SO_3H} \longrightarrow \underset{\text{(precipitate)}}{R-SO_3Na} + H_2O \quad (4)$$

Since the reaction of formula (4) occurs very rapidly, it suffices to sufficiently mix the solid-state ion exchange resin and the sodium hydroxide solution. Alternatively, said ion exchange resin may be previously filled in a cylindrical object and the sodium hydroxide solution is passed through such cylindrical object. The used ion exchange resin discharged from nuclear power plants is either powdery (particle size being around 40 μm) or granular (particle size being around 500 μm). Both forms of resin can be used for the purpose of this invention.

Beside such used ion exchange resin, a used filter aid (such as cellulose fiber) is also usable for said purpose.

Figure 3:
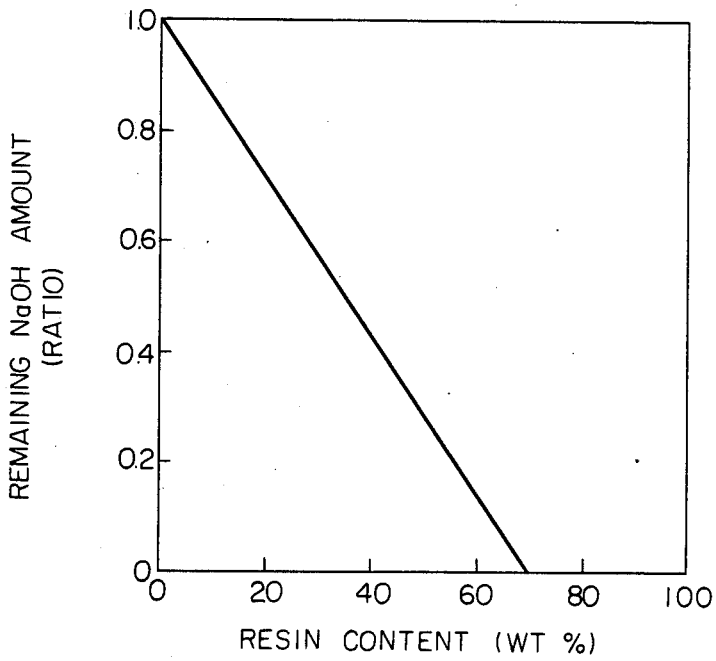
FIG. 3 is a graph showing the remaining amount of sodium hydroxide decreased by the adsorption by an ion exchange resin.

FIG. 3 shows the reduction of NaOH by the addition of ion exchange resin to the sodium hydroxide solution. It was observed that the amount of NaOH was reduced in accordance with the reaction of formula (4), and at the point when the amount of ion exchange resin added became 2.3 times by weight the initial amount of NaOH (that is, when the amount of ion exchange resin became 70% as against 30% of NaOH), NaOH was perfectly eliminated and the solution became ordinary water. Separation of solid-state ion exchange resin and water is easy. Also, since the metal ions of radioactive nuclides such as cobalt, cesium, manganese, etc., are adsorbed in the ion exchange resin, there scarecely exists radioactivity in the ordinary water separated from the ion exchange resin. Therefore, the separated water may be released to the living environment or evaporated if the measured value of radioactivity thereof is below the prescribed level.

On the other hand, the ion exchange resin which has adsorbed sodium and radioactive nuclides is preferably solidified with an inorganic solidifying agent such as cement or sodium silicate. Generally, ion exchange resin has a high water absorptivity, and in case a simple method such as precipitation method is used for its separation from water as mentioned above, it can not be sufficiently dehydrated and the particles thereof contain a fairly large amount of water in the inside. Therefore, in case of using plastic for solidifying the resin, the hardening thereof is obstructed by the water remaining in the inside of the resin particles to retard the solidification. However, in case of using an inorganic solidifying agent, there is no necessity of giving consideration to the remaining water in the resin. Cement and sodium silicate (water glass), which are the typical examples of inorganic solidifying agent, are themselves a hydraulic solidifying agent which requires water when solidified, so that it is expedient to separate the ion exchange resin in a water-containing state and add cement powder thereto to effect solidification. Solidification can be also effected by adding powdery sodium silicate and its hardening agent, in place of cement. In this case, a more compact solidified body can be obtained.

This NaOH adsorbing process by use of ion exchange resin is preferably carried out successively to the anion sedimentation process for achieving an efficient treatment of radioactive waste. That is, a substance (such as barium hydroxide) which is combined with anions to form an insoluble salt is added to the radioactive waste liquid principally composed of sodium sulfate, thereby settling the anions into a sediment, and then a solid-state substance (such as ion exchange resin) which adsorbs cations is added to the solution to settle the remaining cations in the solution while turning the residual waste liquid into neutral water. According to this method, precipitation of both anions and cations in the radioactive waste liquid can be accomplished in a single reaction vessel. The precipitate formed is a mixture of the precipitated anions and cations, so that solidification of such mixture provides a greater effect of volume reduction of the waste than in case the respective precipitates of anions and cations are solidified individually. As the solid substance for adsorbing the cations and settling them, there can be used the used ion exchange resin, which is a radioactive waste material, or a used filter aid, but such substance lowers the strength of the solidified body because of low modulus of elasticity. Therefore, the packing rate of ion exchange resin, etc., is strictly regulated for meeting the strength requirement of the solidified body that it must have a uniaxial compression strength of at least 150 kg/cm$^2$. Consequently, a substantial portion of the produced solidified body is occupied by the ion exchange resin.

Figure 4:
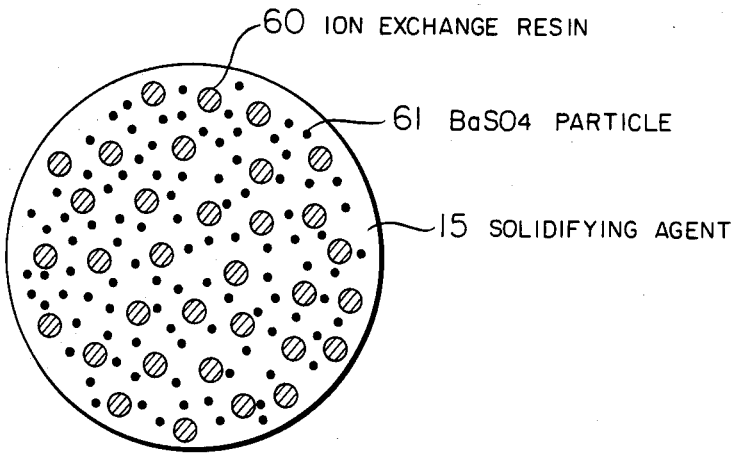
FIG. 4 is a sectional view of a solidified body produced by the method of this invention.

On the other hand, the sediment or precipitate of anions is high in moduuus of elasticity because of the ion crystalline salt such as barium sulfate, and hence such sediment increases the strength of the solidified body. So, when said two types of precipitate are mixed and solidified, there is produced a solidified body in which barium sulfate of high modulus of elasticity fills up the areas around the particles of ion exchange resin of low modulus of elasticity as shown in FIG. 4. Therefore, such solidified body has a greater strength than the solidified body formed by using an ion exchange resin alone. As a result, the packing rate of ion exchange resin can be improved, and further, since the precipitate of the substance (barium sulfate) combined with anions is solidified simultaneously with the ion exchange resin, it becomes unnecessary to form a solidified body of the precipitate of barium sulfate, etc. Thus, the present invention can realize a striking waste volume reducing effect.

Figure 5:
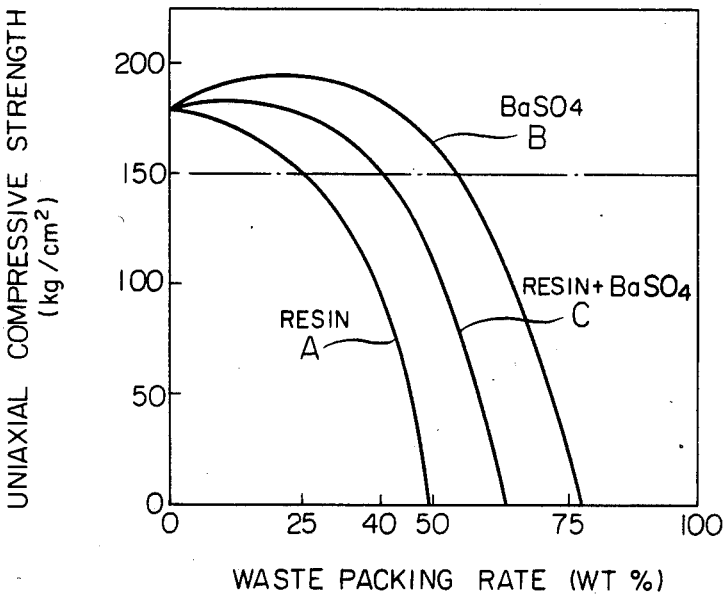
FIG. 5 is a graph showing the relation between the waste packing rate and the solidified body strength.

FIG. 5 graphically illustrates the strength of the solidified body made by adding barium sulfate to ion exchange resin. In the illustrated examples, sodium silicate (water glass) was used as solidifying agent. In the graph of FIG. 5, curve A shows the uniaxial compressive strength of the solidified body made by solidifying resin alone with the solidifying agent, curve B represents the result obtained when barium sulfate alone was solidified with the solidifying agent, and curve C represents the case where a 7:3 mixture of resin and barium sulfate was solidified with the solidifying agent. From the comparison of curves A and C, it is seen that the produced solidified body has a greater strength when a mixture of resin and barium sulfate is used for forming a solidified body than when resin alone is used. Thus, according to the present invention, the packing rate of the waste material can be improved by an amount corresponding to the improvement of strength of the solidified body. It will be seen that the maximum waste packing rate for satisfying the standard uniaxial compressive strength of 150 kg/cm$^2$ of the solidified body is approximately 25% in the case of curve A, whereas it can be increased up to about 40% in the case of curve C.

As described above, the present invention is capable of not only simplifying the radioactive waste treating process but also remarkably reducing the volume of waste by treating together the radioactive waste liquid and used ion exchange resin released from nuclear power plants. In the present invention, in case the radioactive waste liquid to be treated is an aqueous solution of neutral salt of sodium sulfate, etc., there is required the used ion exchange resin of the amount which is 2 to 3 times by weight the solid matter (including dissolved ions) in the radioactive waste liquid for effecting adsorption and settling of the cations. In view of the fact that the rate of generation of used ion exchange resin in the existing nuclear power plants, especially BWR power plants, is increasing every year, the present invention is advantageous in this respect, too.

The present invention will be further described with reference to the concrete examples of the invention.

EXAMPLE 1

Treated in this example is a concentrated radioactive waste liquid principally composed of sodium sulfate and discharged from a boiling-water type nuclear power plant. Sulfuric acid ions in the waste liquid are deposited as barium sulfate and the remaining sodium ions in said waste liquid are deposited by having them adsorbed on the particles of used ion exchange resin to thereby reform the waste liquid into ordinayy water. This water is separated from the mixture of said two type of sediment, and the water-free mixture is solidified with an inorganic solidifying agent. A flow chart of the treating system in this example of the invention is shown in FIG. 1.

The concentrated waste liquid principally composed of sodium sulfate (hereinafter referred to simply as concentrated waste liquid) 1 is a mixture of sodium hydroxide and sulfuric acid produced when regenerating the ion exchange resin in a condensing desalting apparatus, the mixture being concentrated to a concentration of about 20–25% by weight. This concentrated waste liquid 1 is stored in tank 4 and supplied to reactor 11 after passing through valve 7. Powder of barium hydroxide 2 stored in tank 5 is also supplied to said reactor 11 through valve 8. The feed of barium hydroxide is preferably equimolar to sodium sulfate in the concentrated waste liquid. In other words, powder of barium hydroxide is added in an amount of approximately 53 kg to 200 liters of the 20% concentrated waste liquid. Reactor 11 having said supplied concentrated waste liquid and barium hydroxide mixed therein is kept at 80° C. by heater 20 and sufficiently stirred and mixed for about one hour by stirrer 53. The solution in reactor 11 becomes cloudy with generation of barium sulfate. The pH of the solution also rises to about 13 due to formation of barium hydroxide. A small portion was collected from said cloudy solution and filtered to separate into solid matter and liquid, and the solid matter was analyzed by X-ray diffractometry while the liquid by atomic-absorption spectroscopy. The analyses confirmed that the solid matter was barium sulfate and the liquid was sodium hydroxide.

Then used ion exchange resin 3 stored in tank 6 is supplied into said cloudy solution 10 in reactor 11 through valve 9. The amount of said used ion exchange resin supplied is such that it is sufficient to adsorb the sodium ions in said cloudy solution. To be concrete, said resin is supplied in an amount of approximately 150 kg on the dry basis (1,500 kg as solution).

Said amount of resin sufficient to adsorb sodium ions in the cloudy solution is explained in more concrete terms. The amount of resin to be added for sufficiently adsorbing sodium ions depends on the amount of sodium sulfate in the concentrated waste liquid. Regarding such sodium sulfate, the sulfuric acid ions are settled and sedimented by barium hydroxide in the first stage of this invention, and in the second stage the sodium ions in the by-produced sodium hydroxide are adsorbed by the resin.

$$\underset{(x\ kg)}{Na_2SO_4} + \underset{(1.92x\ kg)}{Ba(OH)_2} \longrightarrow \underset{(1.64x\ kg)}{BaSO_3} + \underset{(0.56x\ kg)}{2NaOH}$$

-continued $$\underset{(0.56x\ kg)}{2NaOH} + \underset{(3x\ kg)}{2R{-}SO_3H} \longrightarrow \underset{(3.2x\ kg)}{2R{-}SO_3Na} + \underset{(0.36x\ kg)}{2H_2O} \quad (5)$$

Thus, supposing that the initial dry weight of sodium sulfate is x kg, barium hydroxide is added in an amount of 1.92 kg in the sedimentation reaction of the first stage, and the resin is added in an amount of 3x kg in the sodium ion adsorption reaction of the second stage. Regarding the resin, since the used ion exchange resin is used, it is duly expected that the exchange capacity of the resin would be slightly reduced. The calculations were made here on the supposition that the used resin maintained 80% of the exchange capacity of the normal resin. In the actual operations, for giving latitude, it is advisable to add the resin in an amount of 3x kg plus 10–20% extra.

After supply of the used ion exchange resin, the materials in reactor 11 are stirred and mixed for about one hour. Reactor 11 needn't be heated during this mixing operation. By approximately one hour stirring and mixing, sodium ions in the solution are completely adsorbed by the ion exchange resin and the solution is made into ordinary water, with a pH of 6–8.

Then stirring in reactor 11 is stopped and the mixture is allowed to stand as it is for about 3hours. Consequently, solid matter 12 settles down at the bottom of the reactor and the supernatant becomes transparent water. The amounts of solid matter and water can be easily calculated as the sedimentation reaction by barium hydroxide and the adsorption of sodium ions by the used ion exchange resin take place at an almost 100% efficiency. In the instant example, the amount of the sediment was about 230 kg and water was about 1,500 kg The sediment was a mixture of 71 kg of barium sulfate and 159 kg of sodium-adsorbed ion exchange resin.

Then the supernatant (water) is removed from reactor 11 by pump 13. It is to be noted that 1,300 kg of water is removed, leaving in the reactor 200 kg of water which is necessary for the solidification of the sediment. The radioactivity in the removed water was below $10^{-5}$ μCi/cc, which assures safe release of removed water into the living environment.

The residual sediment 12 and water in reactor 11 are stirred and mixed by stirrer 53 to form a slurry. This slurry of sediment 12 and water is supplied into 200-liter drums 19 through valve 14. 215 kg of slurry is supplied into each drum. Also supplied into each drum is 145 kg of mixture of powdery sodium silicate and its powdery hardening agent stored in tank 16 (said mixture being hereinafter referred to as water glass solidifying agent). The feed of said water glass solidifying agent is calculated by load cell 17. The water glass solidifying agent supplied into drum 19 is sufficiently mixed with said slurry by stirrer 54, and the mixture is allowed to stand at room temperature to solidify by itself. There were produced two solidified bodies (each packed in a drum) in this example.

After one-month curing, the properties of the solidified body were examined. The solidified body had a sectional structure as shown in FIG. 4, in which the $BaSO_4$ particles 61 filled the areas surrounding the granules of ion exchange resin 60, and they were in a state of being fixed and solidified in the solidifying agent 15. Both resin 60 and $BaSO_4$ particles 61 were seen dispersed quite uniformly. Also, the solidified body had a sufficient strength, with its uniaxial compressive strength being over 150 kg/cm$^2$.

As described above, according to this example of the invention, the concentrated waste liquid and the used ion exchange resin are treated through a sedimentation process, so that the waste disposal is greatly simplified and it also becomes possible to realize a substantial volume reduction of the waste and to obtain the strong solidified bodies of waste material.

By using the processing apparatus of FIG. 1, there were produced the solidified bodies according to the same process as in the preceeding example except that cement was used as solidifying agent. The obtained solidified bodies were as strong as those obtained in the preceeding example where water glass was used as solidifying agent. Two solidified bodies were obtained in this case, too.

Figure 6:
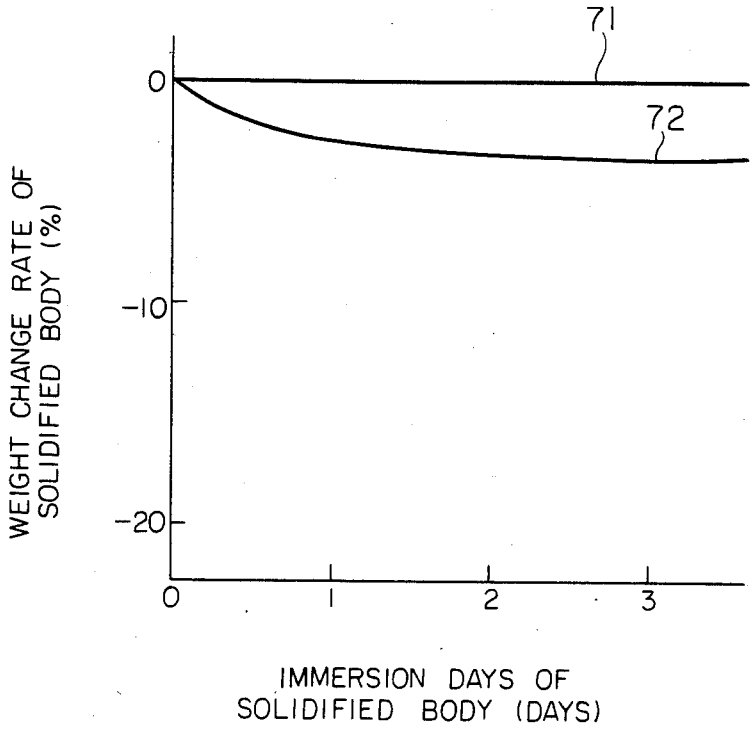
FIG. 6 is a graph showing the weight change of the solidified bddy when immersed in water.

Then, the water resistance of said solidified bodies made by using cement and water glass as solidifying agent, respectively, was examined. Cylindrical samples of 20 mm in diameter and 40 mm in height were obtained from the respective solidified bodies by core sampling, and these samples were immersed in 500 ml of deionized water and their weight change was measured, obtaining the results shown in FIG. 6. The solidified body obtained by using cement as solidifying agent suffered absolutely no weight change as shown by straight line 71, indicating the very excellent water resistance of this solidified body. On the other hand, the solidified body made by using water glass solidifying agent had an approximately 3% loss of weight in the initial phase of immersion but thereafter suffered no weight reduction as shown by curve 72. It was confirmed by analyzing the immersion water that the weight loss in the initial phase of immersion was due to the elution of disodium hydrogenphosphate ($Na_2HPO_4$) by-produced when water glass was hardened. However, no noteworthy problem arises from such degree of elution of disodium hydrogenphosphate from the solidified body made by using water glass solidifying agent. More significant is the fact that it has been confirmed that the solidified body made by using water glass solidifying agent is less in the rate of elution of radioactivity, by about one order, than the solidified body made by using cement (see The Proceedings of the Fall Subcommittee Meeting of Japan Atomic Energy Society, 1984, G38). The foregoing results confirm that according to the present invention, there can be produced a solidified body of radioactive waste with extremely high water resistance, whether cement or water glass is used as solidifying agent.

EXAMPLE 2

Figure 7:
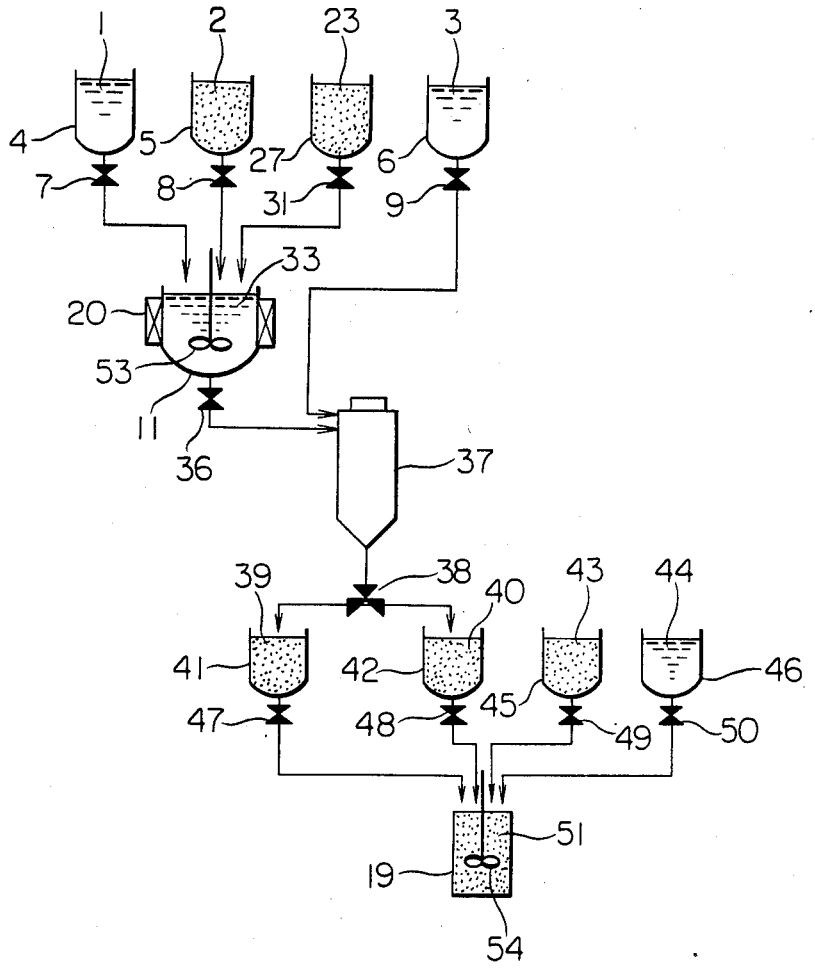
FIG. 7 is a flow chart of Example 2 of the present invention.

This example employs the same process as Example 1 for treating the concentrated waste liquid to form a sediment of barium sulfate, but in this example, sodium silicate (water glass) is synthesized from sodium ions and the dry powder of said two materials (barium sulfate and sodium silicate) is mixed with the dry powder of ion exchange resin and the mixture is solidified in a drum. FIG. 7 illustrates a flow chart of the processing system used in this example. Concentrated waste liquid 1 stored in tank 4 is supplied into reactor 11 through valve 7. Then barium hydroxide 2 stored in tank 5 is charged into said concentrated waste liquid in reactor 11 through valve 8. The amounts of said concentrated waste liquid and barium hydroxide supplied are the same as in Example 1. The mixture of concentrated waste liquid and barium hydroxide in said reactor 11 is kept at 80° C. by heater 20 and stirred by stirrer 53 for about one hour. After this one-hour stirring, the solution was found turned into a sediment of barium hydroxide and an aqueous solution of sodium hydroxide. Then, with the inside of reactor 11 kept at 80° C., silicic acid 23 stored in tank 27 was supplied into said reactor 11 through valve 31 and reacted for about 2 hours under stirring by stirrer 53. The feed of silicic acid 23 was about 1.5 times the feed of barium hydroxide. Immediately after supply of silicic acid, the solution in reactor 11 was in such a state that the particles of silicic acid were dispersed in the solution, but silicic acid was gradually reacted with sodium hydroxide as shown by formula (5) below to produce sodium silicate (water glass). In two hours, the reaction was totally completed and the particles of silicic acid disappeared.

$$2NaOH + H_2SiO_3 \longrightarrow \underset{\text{(water glass)}}{Na_2O.(SiO_2)_2} + H_2O \qquad (6)$$

As a result, there was produced a mixture 33 of sediment of barium sulfate and solution of water glass in the reactor. This mixture 33 is then supplied to rotary vane evaporator 37 through valve 36. Said mixture 33 is dried and powdered in said evaporator 37, then passed through branching valve 38 and stored in tank 41 as mixed powder 39. It was confirmed that this mixed powder 39 was composed of barium sulfate and powder of sodium silicate (water glass).

The slurry of used ion exchange resin 3 stored in tank 6 is dried and powdered separately from said mixture 33. That is, when valve 36 is closed, valve 9 is opened to supply said slurry of ion exchange resin 3 into said rotary vane evaporator 37 where said slurry is dried and powdered, then passed through branching valve 38 and stored in tank 42. Then, 140 kg of mixed powder 39 and 80 kg of resin powder 40 are supplied into drum 19 through valves 47 and 48, respectively, and mixed together in said drmm. Thereafter, about 40 kg of hardening agent 43 is supplied into said drum from tank 45 through valve 49, with simultaneous supply of about 80 kg of water 44 from water tank 46 through valve 50. The mixture of the supplied materials is stirred in drum 19 by stirrer 54 for a few minutes to form a pasty mixture 51 and the latter is left as it is to let it cure and solidify by itself.

Figure 8:
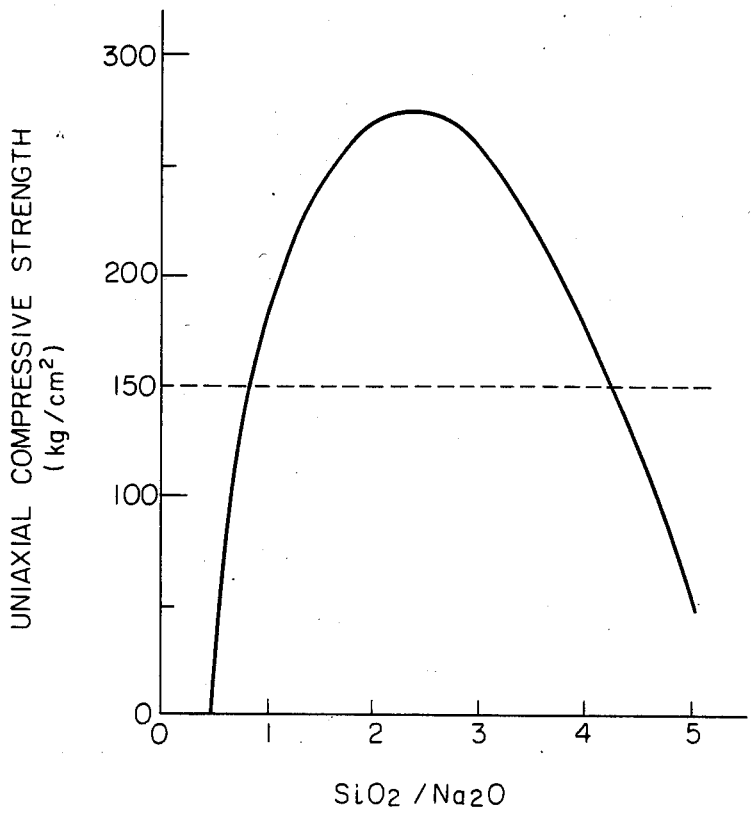
FIG. 8 is a graph showing the dependency of the solidified body strength on the SiO /$Na_2O$ ratio.
Figure 9:
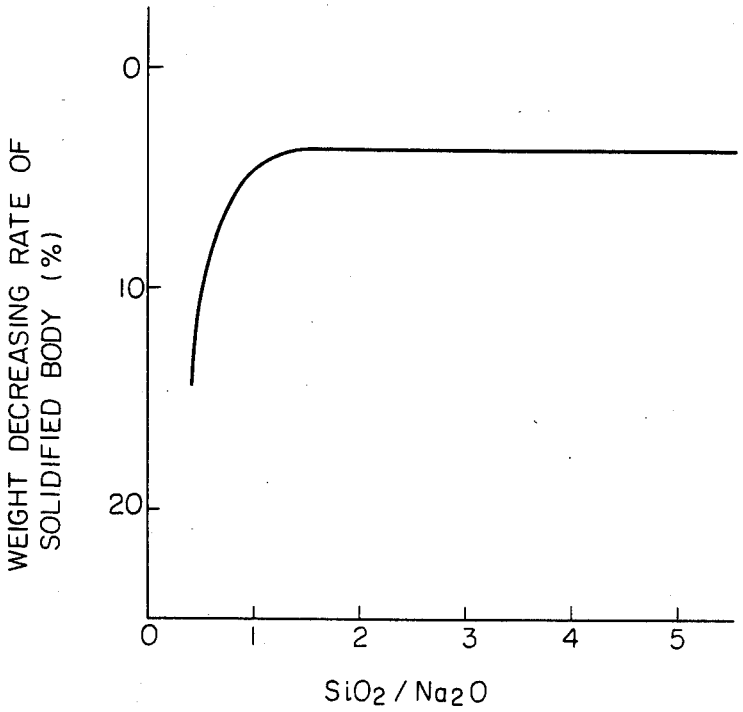
FIG. 9 is a graph showing the relation between the weight reduction of the solidified body when immersed in water and the $SiO_2/Ba_2O$ ratio.

The obtained solidified body after one-month curing had excellent water resistance and high strength as the one produced in Example 1. It was thus confirmed that the objective solidified body with sufficiently high strength can be produced by using water glass prepared in this example (synthesized by reactor 11) as solidifying agent. Also, since the water glass prepared in this example is synthesized by adding silicic acid ($H_2SiO_3$) to sodium hydroxide (NaOH) which is by-produced when forming the sediment of barium sulfate by adding barium hydroxide to the concentrated waste liquid, it is possible to synthesize water glass of any desire composition by properly adjusting the amount of silicic aiid added. Generally, water glass is represented by the chemical formula $Na_2O.nSiO_2$, and its composition is usually expressed by weight ratio of silicon oxide ($SiO_2$) and sodium oxide ($Na_2O$). By using the apparatus shown in FIG. 7, there were produced the solidified bodies in the same way as described above but by changing the amount of silicic acid 23 added, and their strength was measured, obtaining the results shown in FIG. 8. In the graph of FIG. 8, the water glass composition ($SiO_2/Na_2O$) was plotted as abscissa and the measured uniaxial compressive strength of the produced solidified bodies as ordinate. As seen from the graph, the solidified body strength is greatly affected by the water glass composition. It is also seen that the water glass composition that can provide the uniaxial compressive strength of 150 kg/cm$^2$ or above, which is the lowest allowable strength of solidified body of waste for ocean dumping thereof, is in the range where $SiO_2/Na_2O \approx 1$ to 4 by weight ratio. Thus, it is recommended to add silicic acid in an amount that would produce the water glass composition ($SiO_2/Na_2O$) of said range. FIG. 9 shows the results of measurement of water resistance of the solidified bodies made by changing the water glass composition in otherwise the same way a described above and immersed in water. In FIG. 9, the water glass composition is represented by $SiO_2/Na_2O$ ratio by weight on the horizontal axis and the weight decreasing rate of solidified body on the vertical axis. It is seen from the graph of FIG. 9 that the water resistance is improved as the proportion of $SiO_2$ in the composition increases, but the water resistance becomes constant when the $SiO_2/Na_2O$ ratio becomes 1 or greater. This can be accounted for by the fact that $SiO_2$ is insoluble in itself and forms the main structure of the solidified body while $Na_2O$ tends to form a soluble salt, so that the increase of $Na_2O$ invites a drop of water resistance. In relation to the optimal range of uniaxial compressive strength shown in FIG. 8, it is advised to select the $SiO_2/Na_2O$ ratio from the range of 1–4.

Figure 10:
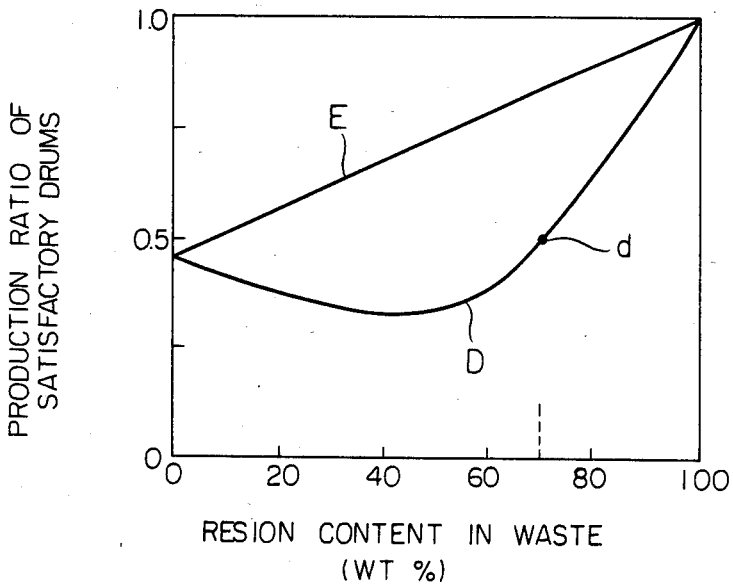
FIG. 10 is a graph showing comparatively the production ratio of the drums produced in case the waste was treated by mixing it with the treating substances according to the process of this invention and those produced inccase the waste was treated singly.

Further, by using the processing apparatus of FIG. 7, there were produced the various solidified bodies by changing the mixing ratio of mixed powder 39 of powdered barium sulfate and water glass and powder of ion exchange resin 40, and their strength was measured. As a result, it was found that the uniaxial compressive strength of solidified body greatly depends on the amount of resin in the solidified body. That is, the strength of solidified body lowers as the ratio of resin increases and the strength rises as the ratio of resin decreases. Since the solidified body is essentially required to have a uniaxial compressive strength of 150 kg/cm$^2$ or above, the waste packing rate is reduced when the resin content in the waste is high, but the packing rate can be increased when the resin content is low. FIG. 10 is a graph showing the production ratio of the drums (solidified bodies) when the solidified bodies satisfying the uniaxial compressive strength of 150 kg/cm$^2$ were produced by changing the ratio of resin powder to the mixed powder of waste (mixture of resin powder and barium sulfate) and water glass. As seen from this graph, in the present invention the production ratio of drums was the lowest when the ratio of resin powder to barium sulfate was 40–70% as shown by curve D. In case the resin powder and the mixed powder of barium sulfate and water glass were solidified severally from each other, the production ratio of drums (shown by line E) was always higher than in case the solidified bodies were produced according to the method of this invention (curve D). In the case of the present invention, as shown by curve D, the production ratio of drums is the lowest, that is, the waste packing rate per drum is the highest, when the resin content in the waste is around 40–50%. This is due to the following reason. In Example 2, the sodium hydroxide (NaOH) produced in the process of conversion of the concentrated waste liquid into a sediment of barium sulfate is entirely altered into water glass serving as solidifying agent, so that the production of water glass is decided according to the amount of concentrated waste liquid. Thus, the ratio of water glass becomes higher than barium sulfate more than necessary, so that although the strength of solidified body becomes higher than 150 kg/cm$^2$, the waste packing rate is reduced to the order of 30% by weight. When the resin content in the waste is increased by adding resin powder to barium sulfate and its ratio reaches 40–50% by weight, the amount of water glass produced becomes such amount that can provide the solidified body strength of just 150 kg/cm$^2$. Since resin powder has been added by an amount corresponding to the reduction of produced water glass, the waste packing rate per drum becomes the highest.

In BWR nuclear power plants, the rate of generation of barium sulfate to resin is approximately 3:7, so that if the ratio of resin is selected to be 70% by weight in the practice of this example of the invention, the waste treatment process is simplified. In this case, the waste packing rate is slightly lowered as indicated by point d on curve D. This is because the generation of water glass is reduced and it is required to add water glass from the outside for satisfying the solidified body strength of 150 kg/cm$^2$. In case barium sulfate and resin are solidified severally, the number of the drums produced becomes always higher than in the case of the present invention. This is due to the fact that in case resin is solidified individually, the maximum waste packing rate that can satisfy the solidified body strength of 150 kg/cm is about 25% by weight as shown by curve A in FIG. 5, and in case barium sulfate is treated individually, the amount of water glass generated becomes superfluous as mentioned before, compelling a reduction of the maximum allowable barium sulfate packing rate to about 30% by weight.

EXAMPLE 3

Figure 11:
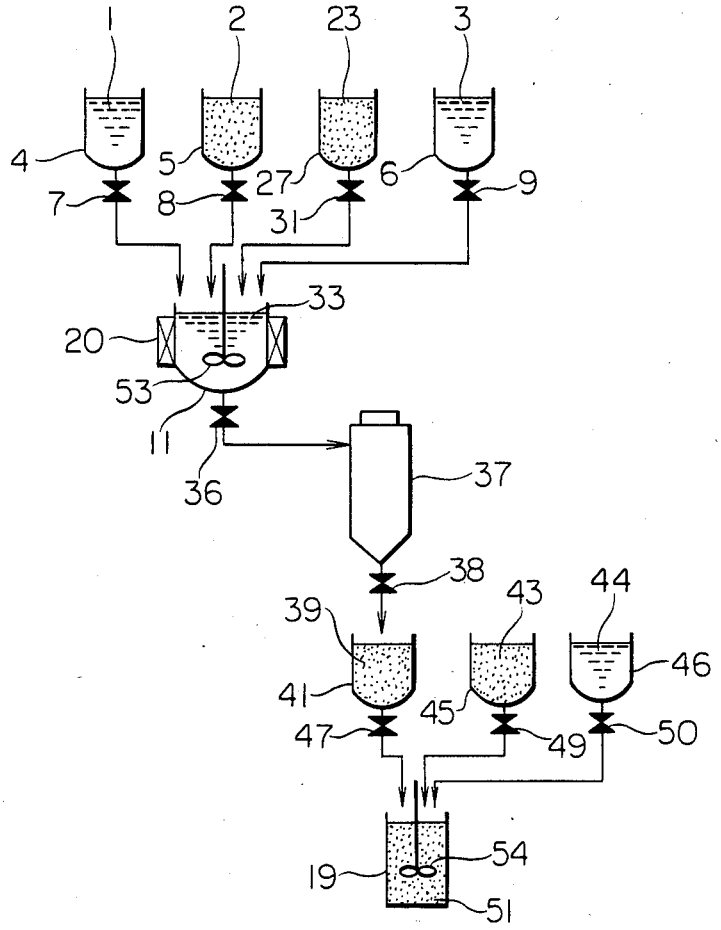
FIG. 11 is a flow chart of Example 3 of this invention.

This example is illustrated in FIG. 11.

In this example, the concentrated waste liquid is first deposited in the form of a sediment of barium sulfate, and then resin is added to let it adsorb NaOH in the remaining liquid. Some NaOH will remain only in case the amount of resin added is not sufficient to adsorb the entirety of NaOH. In this case, silicic acid 23 is supplied from tank 27 into reactor 11 where NaOH remains to synthesize a solidifying agent (water glass). As a result, there remains in reactor 11 an aqueous solution containing insolubilized barium sulfate, inactivated resin and water glass. Then the material from this reactor 11 is supplied into centrifugal thin-film dryer 37 where said material is dried and powdered and then solidified by adding a solidifying agent, a hardening agent and water. Since the solidifying agent already exists (synthesized water glass) in the dry powder, the solidifying agent is added only to supply the shortage in the solidifying step.

The reaction product in the reactor may be made into a slurry by a concentrator, instead of drying and powdering it. In this case, it is unnecessary to add water in the solidifying step.

In this example, since silicic acid is added to form water glass in case the amount of resin is short, there is provided a processing system that can accommodate itself to the variation of the amount of resin.

In FIG. 11, the parts indicated by the same reference numerals as used in FIGS. 1 and 7 denote the same or corresponding parts in said Figures.

EXAMPLE 4

This example concerns the case where the present invention was applied to the treatment of waste liquid composed of sodium borate generated from PWR nuclear power plants. In this example, the insolubilization reaction progresses in the way expressed by the following formula:

$$Na_2B_4O_7 + Ba(OH)_2 \longrightarrow \underset{\text{(precipitate)}}{BaB_4O_7} + 2NaOH \quad (7)$$

Barium borate ($BaB_4O_7$) is also an insoluble sediment, and therefore the insolubilization can be accomplished in the same way as in the case of waste liquid composed of sodium sulfate. In this case, however, there is a possibility that the reaction solution becomes viscous to defy sedimentation unless the process is carried out at a temperature above 60° C., preferably around 80° C. Other treatments can be accomplished in the completely same way as in preceeding Examples 1-3.

EXAMPLE 5

Discussed here is the case where sodium sulfate waste liquid generated from nuclear fuel reprocessing plants is treated. In this case, the insolubilization reaction advances as follows:

$$2NaNO_3 + Ba(OH)_2 \rightarrow Ba(NO_3)_2 + 2NaOH \quad (8)$$

Insolubilization can be accomplished extensively with $Ba(NO_3)_2$, too, as its solubility is below 1/10 of that of $NaNO_3$. Sedimentation can be also easily accomplished at normal temperature. Other processes can be carried out with ease after the manner of Examples 1-3 described above.

EXAMPLE 6

In case of using an ion exchange resin having about 10 times greater exchange capacity than the presently used ones or in case the amount of concentrated waste liquid generated is only about 1/10 of the ordinary level, it is possible to accomplish insolubilizatoon without adding barium hydroxide because, in such cases, both anions and cations in the waste liquid can be entirely adsorbed by the ion exchange resin. According to this example, there is no need of adding barium hydroxide and the radioactive waste can be made into an insoluble sediment only by using an ion exchange resin.

Also, when the waste liquid is treated with an additive, or a mixture of two or more miscible additives, which is capable of turning sulfuric acid ions and alkali metal ions into an insoluble sediment, addition of ion exchange resin 3 in said Examples 1-3 becomes unnecessary. According to this example, processing of waste liquid is possible without relying on the waste treating capacity of the ion exchange resin. The additives usable in this example include commercially available phosphorus-free detergent builders (hard water softening agent). A typical example of such phosphorus-free builders is synthetic zeolite, and this substance is considered to be an inorganic ion exchanger. If barium ions are beforehand adsorbed on this synthetic zeolite, it can adsorb sodium ions in the presence of a large quantity of sodium ions and releases barium ions. This enables simultaneous conversion of both sulfuric acid ions and sodium ions into insoluble substance. Other additive than said synthetic zeolite can be similarly applied to the process of this example if there is available such additive which is capable of simultaneous conversion of sulfuric acid ions and sodium ions into insoluble precipitate.

As described above, in accordance with the present invention, it is possible to carry out processing and disposal of radioactive waste liquid and used ion exchange resin in an in-line system, and the processing steps and apparatus can be greatly simplified. It is further possible according to this invention to produce a waste package of radioactive waste with high strength and water resistance and to also attain a sizable reduction of the volume of radioactive waste.

What is claimed is:

1. A method for treating a radioactive waste liquid principally composed of sodium sulfate, which comprises:
   - adding a hydroxide of an alkaline earth metal to said radioactive waste and combining the hdyroxide with the radioactive waste liquid thereby producing an insoluble precipitate;
   - adding a used ion exchange resin to the radioactive waste liquid and combining the resin with the waste liquid to produce an insoluble precipitate;
   - adding silicic acid to the radioactive waste;
   - precipitating the formed precipitates;
   - thereafter concentrating the radioactive waste liquid containing therein the precipitates and silicic acid; and
   - adding a sodium silccate hardening agent to the concentrated radioactive waste, mixing and solidifying the mixture to form an insoluble solid waste package.

2. The method of claim 1, wherein said step of concentrating includes drying the precipitates and silicic acid; and said step of adding the sodium silicate hardening agent includes adding and mixing water to produce the mixture.

3. A method for treating a radioactive waste liquid principally composed of soluble inorganic salt dissociated into anions and cations, comprising:
   - adding a first substance to the radioactive waste liquid and thereby combining the first substance with the anions to form an insoluble precipitate;
   - adding a solid second substance composed of a used ion exchange resin or used cellulose filter aid that adsorbs cations to the waste liquid and thereby adsorbing the cations and producing the solid second substance with the cations adsorbed thereon; and
   - separating the insoluble precipitate and the solid second substance with the adsorbed cations from the liquid portion of the waste liquid and purifying the liquid portion.

4. The method of claim 3, wherein the used ion exchange resin is generated from nuclear power plants and further thereby forms an insoluble precipitate with the cations.

5. A method for producing a waste package of radioactive waste, which comprises: adding a first substance to a radioactive waste liquid, composed of soluble inorganic salt dissociated into anions and cations; combining the first substance with the anions in said radioactive waste liquid, thereby forming an insoluble first precipitate;

adding to said radioactive waste liquid a solid second substnace composed of a used ion exchange resin or used cellulose filter aid thereby adsorbing the cations in said waste liquid with the second substance and forming a second insoluble precipitate; and solidifying the mixture of said first and second precipitates with a solidifying agent to form a solid waste package.

6. The method for producing a waste package of radioactive waste according to claim 5, including separating said first and second precipitates from the liquid of the waste liquid prior to said step of solidifying.

7. The method according to claim 5, wherein the radioactive waste liquid is an aqueous solution mainly composed of at least one of sulfuric acid, boric acid, nitric acid, sodium sulfate, sodium borate and sodium nitrate, or a mixture of two or more of them.

8. The method according to claim 5, wherein the first substance which is combined with anions in the radioactive waste liquid is a hydroxide or an oxide of an alkaline earth metal.

9. The method according to claim 5, wherein a hydraulic solidifying agent is used as a solidifying agent for solidifying the precipitate.

10. The method according to claim 9, wherein the hydraulic solidifying agent is cement.

11. The method according to claim 9, wherein the hydraulic solidifying agent is an alkali silicate.

12. The method according to claim 9, wherein the water used for the setting of the hydraulic solidifying agent is a liquid portion which remained after separating the precipitate from the radioactive waste liquid.

13. The method according to claim 5, wherein the liquid portion used for the setting of the hydraulic solidifying agent is one which has been reformed to an extent equal to ordinary water.

14. A method for producing a waste package of radioactive waste, which comprises: adding a first substance composed of a hydroxide of an alkaline earth metal to a radioactive waste liquid principally composed of soluble sodium sulfate dissociated into anions and cations;

combining the first substance with the anions thereby forming an insoluble first precipitate;

adding to said waste liquid a second substance composed of used ion exchange resin and adsorbing sodium ions in the waste liquid on said ion exchange resin thereby forming an insoluble second precipitate; and solidifying said first and second precipitates with a solidifying agent to form a solid waste package.

15. The method according to claim 14, wherein said steps of combining and adsorbing thereby produce the step of reforming the remaining waste liquid into ordinary water;

separating a sufficient amount of said water for leaving an amount necessary for effecting said solidifying with a hydraulic solidifying agent.

16. The method according to claim 14, wherein the alkaline earth metal is barium hydroxide, and the insoluble first precipitate is barium sulfate.

17. The method according to claim 16, wherein said step of combining is conducted while maintaining the temperature of the waste liquid at about 80 degrees C.

18. The method according to claim 17, wherein the step of adsorbing produces sodium hydroxide and wherein the amount of ion exchange resin added is about 2.3 times by weight the amount of produced sodium hdyroxide.

19. The method according to claim 15, wherein the hydraulic solidifying agent is an alkali silicate and its hardening agent.

20. The method according to claim 14, wherein the concentration of the radioactive waste liquid principally composed of sodium sulfate is 20–25% by weight.

21. The method according to claim 15, wherein the pH of the waste liquid reformed into ordinary water is 6–8.

* * * * *